US011396834B2

(12) United States Patent
Osada

(10) Patent No.: US 11,396,834 B2
(45) Date of Patent: Jul. 26, 2022

(54) BLOW-BY GAS DISCHARGING DEVICE

(71) Applicant: ISUZU MOTORS LIMITED, Tokyo (JP)

(72) Inventor: Hideki Osada, Fujisawa (JP)

(73) Assignee: ISUZU MOTORS LIMITED, Tokyo (JP)

( * ) Notice: Subject to any disclaimer, the term of this patent is extended or adjusted under 35 U.S.C. 154(b) by 0 days.

(21) Appl. No.: 17/280,569

(22) PCT Filed: Sep. 24, 2019

(86) PCT No.: PCT/JP2019/037261
§ 371 (c)(1),
(2) Date: Mar. 26, 2021

(87) PCT Pub. No.: WO2020/067006
PCT Pub. Date: Apr. 2, 2020

(65) Prior Publication Data

US 2022/0003138 A1 Jan. 6, 2022

(30) Foreign Application Priority Data

Sep. 27, 2018 (JP) ..... JP2018-182123

(51) Int. Cl.
*F01M 13/04* (2006.01)
*F01M 11/04* (2006.01)

(52) U.S. Cl.
CPC ..... *F01M 13/04* (2013.01); *F01M 11/04* (2013.01); *F01M 2013/0422* (2013.01); *F01M 2013/0466* (2013.01); *F01M 2013/0472* (2013.01)

(58) Field of Classification Search
CPC ..... F01M 13/04; F01M 11/04; F01M 2013/0422; F01M 2013/0466; F01M 2013/0472; F01M 13/0416; F01M 2013/0027; F01M 13/00; F02F 7/0073
See application file for complete search history.

(56) References Cited

U.S. PATENT DOCUMENTS

2011/0061635 A1 3/2011 Bukhenik
2014/0345580 A1 11/2014 Gao et al.

FOREIGN PATENT DOCUMENTS

JP 58156112 U * 10/1983 ..... F23G 5/04
JP S58156112 U 10/1983
JP S62721 U * 1/1987
(Continued)

OTHER PUBLICATIONS

International Search Report and Written Opinion for related PCT App No. PCT/JP2019/037261 dated Dec. 3, 2019.

*Primary Examiner* — Jacob M Amick
*Assistant Examiner* — Charles J Brauch
(74) *Attorney, Agent, or Firm* — Procopio, Cory, Hargreaves & Savitch LLP

(57) ABSTRACT

This blow-by gas discharging device is provided with: a blow-by gas pipe 23 that extends from the upper end height position to the lower end height position of an internal combustion engine 1 and that has an outlet 33 exposed to outside air and opened to the atmosphere; a heating chamber 24 that is provided to the midway of the blow-by gas pipe, and formed in a flywheel housing 10 of the internal combustion engine so as to heat a blow-by gas; and a drain mechanism that is provided to the heating chamber so as to discharge oil accumulated in the heating chamber.

3 Claims, 6 Drawing Sheets

(56) References Cited

FOREIGN PATENT DOCUMENTS

| | | | | |
|---|---|---|---|---|
| JP | S62000721 | U | | 1/1987 |
| JP | 01095513 | U | * | 6/1989 |
| JP | H01095513 | U | | 6/1989 |
| JP | 2012172628 | A | * | 9/2012 |
| JP | 2012172628 | A | | 9/2012 |
| WO | 2013094452 | A1 | | 6/2013 |

* cited by examiner

BLOW-BY GAS DISCHARGING DEVICE

CROSS-REFERENCE TO RELATED APPLICATIONS

This application is a U.S. National Stage entry of PCT Application No: PCT/JP2019/037261 filed Sep. 24, 2019, which claims priority to Japanese Patent Application No. 2018-182123 filed Sep. 27, 2018, the contents of which are incorporated herein by reference.

TECHNICAL FIELD

The present disclosure relates to a blow-by gas discharge device, and more particularly, to a device for discharging blow-by gas into the atmosphere through a blow-by gas pipe exposed to the outside air.

BACKGROUND ART

In general, blow-by gas generated in the crankcase of an internal combustion engine is circulated into an air intake system, is sent into a combustion chamber, and is burned together with air-fuel mixture in the combustion chamber.

CITATION LIST

Patent Literature

Patent Literature 1: JP H01-95513 U

SUMMARY OF INVENTION

Technical Problem

Meanwhile, a device that discharges blow-by gas into the atmosphere instead of circulating it into an air intake system is also known (see Patent Literature 1 for instance). In this case, it can be considered to provide a blow-by gas pipe that is exposed to the outside air and that extends from a height position of an upper end part of the internal combustion engine to a height position of a lower end part of the internal combustion engine, and to discharge the blow-by gas into the atmosphere through the blow-by gas pipe.

However, in such a case, since the blow-by gas pipe is cooled by the outside air, the blow-by gas passing through the pipe is also cooled, so condensed water attributable to the blow-by gas is generated in the pipe. If the temperature of the outside air is equal to or lower than the freezing point, the condensed water may freeze and block the inside of the pipe.

The present disclosure provides a blow-by gas discharge device capable of preventing freezing of condensed water in a blow-by gas pipe.

Solution to Problem

According to an aspect of the present disclosure, a blow-by gas discharge device includes: a blow-by gas pipe that extends from a height position of an upper end part of an internal combustion engine to a height position of a lower end part of the internal combustion engine, the blow-by gas pipe being exposed to an outside air and having an outlet part released to an atmosphere; a heat chamber provided in a middle of the blow-by gas pipe and in a flywheel housing of the internal combustion engine, the heat chamber being configured to heat blow-by gas; and a drain mechanism provided in the heat chamber and configured to discharge oil accumulated in the heat chamber.

The drain mechanism may include a drain valve configured to prevent the oil from being discharged when the drain valve is closed, and to allow the oil to be discharged when the drain valve is opened.

The drain valve may be a check valve, and the check valve may include a valve body, and a biasing member configured to bias the valve body toward a valve closing side.

The drain valve may be a drain bolt.

The drain valve may be configured to be accessible through a hole provided in the flywheel housing.

Advantageous Effects of Invention

According to the present disclosure, it is possible to prevent freezing of condensed water in a blow-by gas pipe.

DESCRIPTION OF EMBODIMENTS

Hereinafter, an embodiment of the present disclosure will be described with reference to the accompanying drawings. However, it is to be noted that the present disclosure is not limited to the following embodiment.

Figure 1:
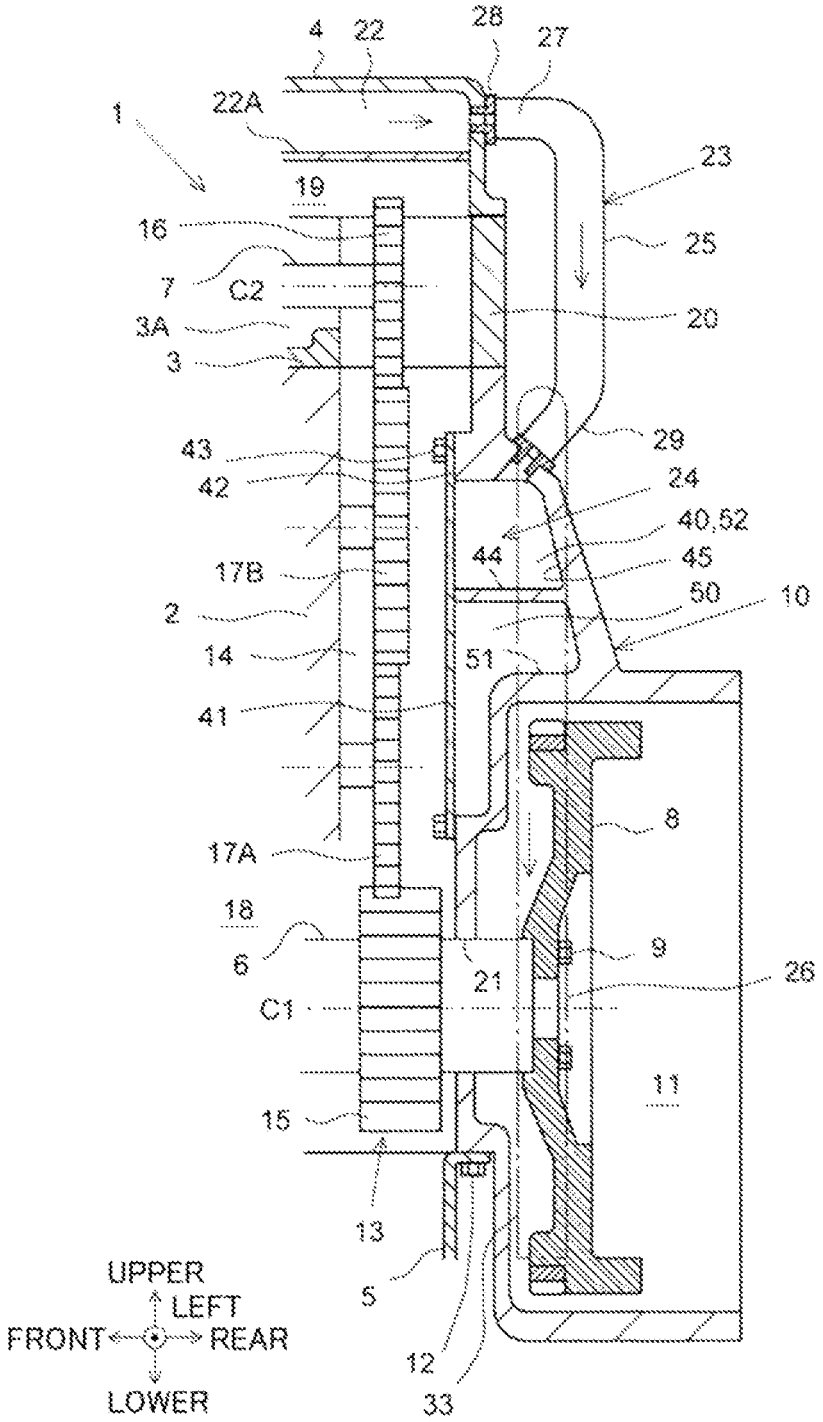
FIG. 1 is a cross-sectional side view illustrating a structure of an end part of an internal combustion engine.

FIG. 1 is a cross-sectional side view illustrating a structure of an end part of an internal combustion engine according to the present embodiment. An internal combustion engine (engine) 1 is a diesel engine mounted on a vehicle (not shown in the drawing), and the vehicle is a large vehicle such as a truck. However, the types, uses, and so on of the vehicle and the engine are not particularly limited, and the vehicle may be a small vehicle such as a car, and the engine may be a gasoline engine. The engine is mounted vertically on the vehicle. The front, rear, left, right, upper, and lower sides of the vehicle and the engine are as shown in the drawing.

The engine 1 includes a cylinder block 2 integrally including a crankcase (not shown in the drawing), a cylinder head 3 fastened to an upper end part of the cylinder block 2, a head cover 4 fastened to an upper end part of the cylinder head 3, and an oil pan 5 fastened to a lower end part of the crankcase. A crankshaft 6 is rotatably supported by the crankcase, and a camshaft 7 is rotatably supported by the cylinder head 3.

A flywheel 8 is attached to a rear end surface part of the crankshaft 6 by a plurality of bolts 9. A flywheel housing 10 that accommodates the flywheel 8 is attached to the cylinder block 2 by bolts or the like (not shown in the drawing). However, the flywheel housing 10 may be integrally formed in the cylinder block 2. In the flywheel housing 10, a cylindrical flywheel chamber 11 is provided, which accommodates the flywheel 8 such that the flywheel is substantially rotatable. A clutch device (not shown in the drawing) is connected to a rear end part of the flywheel housing 10, and a clutch input shaft of the clutch device is coaxially connected to the crankshaft 6. A part of the oil pan 5 is attached to the flywheel housing 10 by a bolt 12.

A mechanism chamber is provided between a rear end surface part of the cylinder block 2 and the flywheel housing 10. Inside the mechanism chamber, a power transmission mechanism that transmits power from the crankshaft 6 to the camshaft 7 is accommodated. In the present embodiment, the power transmission mechanism includes a gear mechanism 13 including a plurality of gears meshing with each other, and the mechanism chamber includes a gear chamber 14. However, the type of the power transmission mechanism is arbitrary, and for example, the power transmission mechanism may include a chain mechanism. The gear mechanism 13 includes a crank gear 15 fixed to the crankshaft 6, a cam gear 16 fixed to the camshaft 7, and a plurality of (in the present embodiment, two) intermediate gears 17A and 17B interposed between the crank gear 15 and the cam gear 16. The gear chamber 14 communicates with a crank chamber 18 in the crankcase, a valve chamber 3A of the cylinder head 3, and a cover chamber 19 of the head cover 4.

C1 and C2 represent a central axis of the crankshaft 6 and a central axis of the camshaft 7, respectively.

A rear end part of the cylinder head 3 is provided integrally with a gear chamber partition wall 20 having a half-rectangular frame shape (a shape like U letter) as seen in a plan view and protruding from the rear end part of the cylinder head 3. An inner space of the gear chamber partition wall 20 is a part of the gear chamber 14. An upper end surface of the flywheel housing 10 is brought into close contact with a lower end surface of the gear chamber partition wall 20, and a lower end surface of the head cover 4 is brought into close contact with an upper end surface of the gear chamber partition wall 20.

A rear end part of the crankshaft 6 protrudes into the flywheel chamber 11 located rearwardly through an insertion hole 21 of the flywheel housing 10. On a peripheral part of the insertion hole 21, a sealing member (not shown in the drawing) is provided, which prevents oil and gas from leaking from the gear chamber 14.

As is known, blow-by gas leaks from a combustion chamber of a cylinder into the crank chamber 18 though a gap between a piston ring and a cylinder bore. The blow-by gas is introduced into the cover chamber 19 through the gear chamber 14 and another gas passing hole.

In the cover chamber 19, an oil separator 22 is provided, which separates oil from blow-by gas. Although not shown in the drawing, the oil separator 22 has a meandering passage that allows blow-by gas to flow therethrough. In the present embodiment, blow-by gas from which oil has been separated by the oil separator 22 is discharged into the atmosphere through a gas pipe 23 serving as a blow-by gas pipe.

The gas pipe 23 is exposed to the outside air, and is cooled directly by the outside air. Especially, the gas pipe 23 of the present disclosure is formed of a metal such as stainless steel, and the entire gas pipe 23 is exposed to the outside air, so it is easily cooled by the outside air. As a result, blow-by gas passing through the gas pipe 23 is also cooled, and condensed water attributable to the blow-by gas is generated in the gas pipe 23. Therefore, for example, in a cold region or the like, when the temperature of the outside air is equal to or lower than the freezing point, the condensed water may freeze and block the inside of the gas pipe 23. If the inside of the gas pipe 23 is blocked, it may disrupt discharge of blow-by gas.

For this reason, in the present embodiment, a heat chamber 24 that heats blow-by gas is provided in the middle of the gas pipe 23. Blow-by gas is heated in the heat chamber 24, whereby generation of condensed water attributable to blow-by gas and freezing thereof are prevented. Especially, the heat chamber 24 is provided inside the flywheel housing 10, is adjacent to the gear chamber 14 with a partition (in the present embodiment, a lid 41 to be described below) interposed therebetween, and heats blow-by gas by heat received from oil in the gear chamber 14. Therefore, it is possible to efficiently heat blow-by gas without providing a dedicated heat source. Hereinafter, the configuration of the blow-by gas discharge device will be described in detail.

The whole of the gas pipe 23 extends from a height position of an upper end part of the engine 1 to a height position of a lower end part of the engine 1. However, the gas pipe 23 is divided into two parts at a position in the middle of the height direction, i.e. an upstream side gas pipe 25 and a downstream side gas pipe 26 (shown by an imaginary line in FIG. 1). The heat chamber 24 is connected between the upstream side gas pipe 25 and the downstream side gas pipe 26. Both of the upstream side gas pipe 25 and the downstream side gas pipe 26 are formed of a metal such as stainless steel, and are exposed to the outside air outside the engine.

An inlet part 27 of the upstream side gas pipe 25 is connected to the oil separator 22. In the head cover 4, an outlet port 28 is provided, which allows blow-by gas from which oil has been separated to outflow from the oil separator 22. The inlet part 27 of the upstream side gas pipe 25 is connected to the outlet port 28. The inlet part 27 of the upstream side gas pipe 25 is an inlet part of the gas pipe 23. Since the head cover 4 and the oil separator 22 are provided at the height position of the upper end part of the engine 1, and the inlet part 27 of the upstream side gas pipe 25 is connected to the oil separator 22, the gas pipe 23 extends downstream from the height position of the upper end part of the engine 1.

The oil separator 22 may not be provided inside the head cover 4, but may be provided outside the head cover 4. The reference symbol "22A" in the drawing represents a partition wall that defines the oil separator 22.

Figure 2:
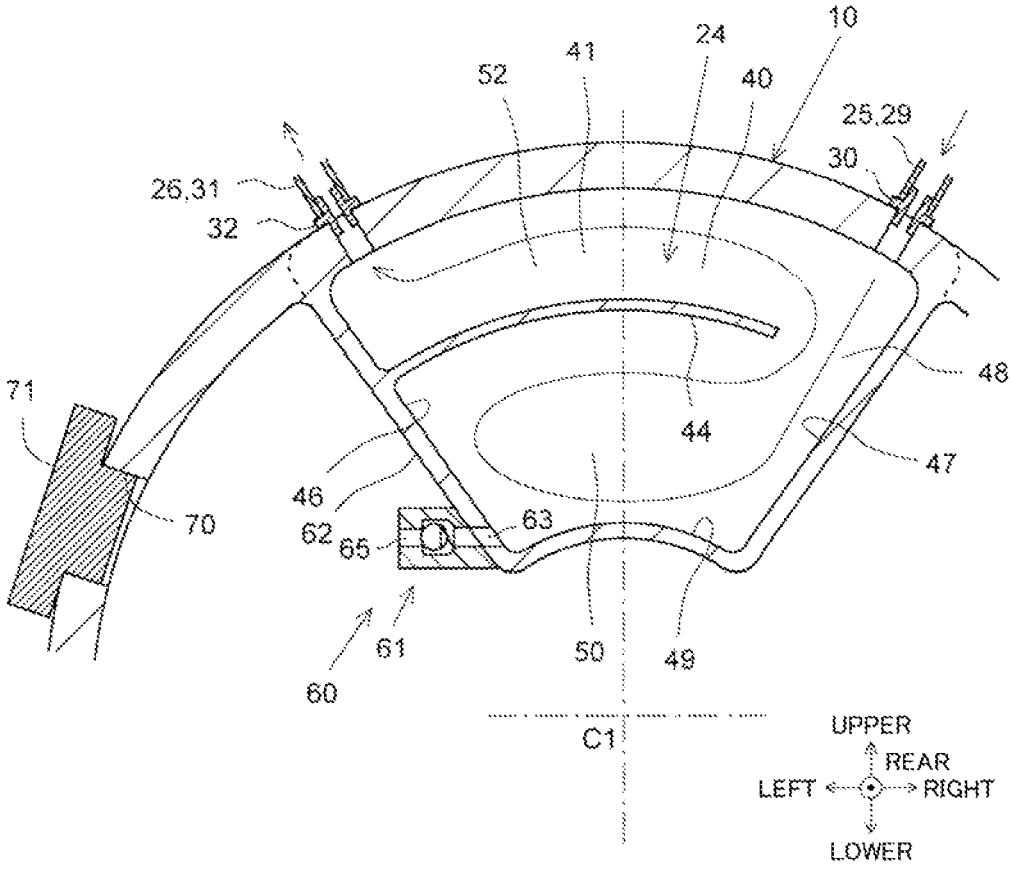
FIG. 2 is a schematic cross-sectional rear view illustrating a heat chamber.

On the other hand, as also shown in FIG. 2, an outlet part 29 of the upstream side gas pipe 25 is connected to the heat chamber 24. In a right and upper end part of the heat chamber 24, an introduction port 30 that introduces blow-by gas into the heat chamber 24 is provided, and the outlet part 29 of the upstream side gas pipe 25 is connected to the introduction port 30.

Also, an inlet part 31 of the downstream side gas pipe 26 is connected to the heat chamber 24. In a left and upper end part of the heat chamber 24, a discharge port 32 that discharges blow-by gas from the heat chamber 24 is provided, and the inlet part 31 of the downstream side gas pipe 26 is connected to the discharge port 32.

On the other hand, as shown in FIG. 1, the downstream side gas pipe 26 passes through the left side of the flywheel housing 10 and extends downward as it goes downstream. Further, an outlet part 33 of the downstream side gas pipe 26 is disposed at the height position of the lower end part of the engine 1, and is released to the atmosphere in a state where the outlet part 33 faces downward. As a result, it is possible to prevent the engine from being contaminated by blow-by gas discharged from the outlet part 33. The outlet part 33 of the downstream side gas pipe 26 is the outlet part of the gas pipe 23. Therefore, the gas pipe 23 is extended to the height position of the lower end part of the engine 1.

The heat chamber 24 is provided inside the flywheel housing 10 and in an upper end part of the flywheel housing 10. The heat chamber 24 is mainly defined by a hollow space 40 provided in the flywheel housing 10 and opened toward the front side, and the lid 41 closing a front end opening of the hollow space 40. The flywheel housing 10 is cast in aluminum or iron, and the lid 41 is formed of an arbitrary metal plate. However, it is preferable that the material of the lid 41 should be a material excellent at heat resistance and corrosion resistance and having relatively high thermal conductivity, for example, aluminum or stainless. The lid 41 is superimposed on a lid mounting surface 42 of the flywheel housing 10 positioned around the front end opening of the hollow space 40, and is fixed detachably and airtightly by a plurality of bolts 43.

As shown in FIG. 2, the heat chamber 24 of the present embodiment has a fan shape or a substantial fan shape extending around the central axis C1 of the crankshaft in a rear view as seen from the rear side (i.e. one end side in the direction of the central axis C1 of the crankshaft). The shape of the lid 41 as seen in a rear view is the same. The introduction port 30 is provided on the right side of the upper end part of the heat chamber 24, and the discharge port 32 is provided on the left side of the upper end part of the heat chamber 24. The central axes of the introduction port 30 and the discharge port 32 extend substantially along the radial direction from the central axis C1 of the crankshaft.

Inside the heat chamber 24, a partition wall 44 that forms a meandering passage in the heat chamber 24 is provided. The partition wall 44 is integrally provided in the flywheel housing 10. As shown in FIG. 1, the partition wall 44 protrudes from a rear inner wall surface 45 of the heat chamber 24, which is the bottom of the hollow space 40, toward the front side integrally and straightly, and is airtightly in contact with the lid 41, thereby vertically partitioning the space in the heat chamber 24. Further, as shown in FIG. 2, the partition wall 44 extends integrally and in an arc shape rightward from the left inner wall surface 46 of the heat chamber 24, which is one side surface of the hollow space 40, to a position where a predetermined gap 48 is formed between the partition wall 44 and a right inner wall surface 47 of the heat chamber 24, which is the other side surface of the hollow space 40.

An outlet of the introduction port 30 faces the gap 48 and a lower inner wall surface 49 of the heat chamber 24. Therefore, the introduction port 30 is configured to allow blow-by gas discharged from the introduction port 30 to linearly flow into a space 50 below the partition wall 44 through the gap 48 as shown by arrows.

As shown in FIG. 1, the heat chamber 24 and the flywheel chamber 11 are overlapped in the vertical direction, and a lower end part of the heat chamber 24 is disposed on a front side of the upper end part of the flywheel chamber 11. In the lower space 50 of the heat chamber 24, a step 51 protruding toward the front side is provided on the rear inner wall surface 45 of the heat chamber 24. Since the step 51 is provided, it is possible to provide the flywheel chamber 11 having a sufficient size on the rear side behind the rear inner wall surface 45 while making room for the flywheel 8.

The shape of the heat chamber 24 is not limited to the above-mentioned shape, and can be changed to an arbitrary shape. Unlike the present embodiment, the number of partition walls 44 may not be one, and a plurality of partition walls may be provided. If possible, the step 51 may not be provided.

By the way, since blow-by gas flows in the heat chamber 24, oil contained in the blow-by gas may gradually accumulate in the heat chamber 24 by long-term use. Further, the accumulated oil may disrupt the flow of blow-by gas in the heat chamber 24 originally scheduled.

In the present embodiment, blow-by gas from which oil has been separated by the oil separator 22 flows into the heat chamber 24. Therefore, the oil content of blow-by gas in the heat chamber 24 is relatively small. Nevertheless, an unacceptable amount of oil may accumulate in the heat chamber 24 over a long period of time.

For this reason, in the present embodiment, a drain mechanism 60 that discharges oil accumulated in the heat chamber 24 is provided in the heat chamber 24. As a result, it is possible to discharge oil accumulated in the heat chamber 24, and it is possible to solve problems attributable to accumulated oil (for example, the problem that accumulated oil disrupts a desired flow of blow-by gas in the heat chamber 24).

Figure 3:
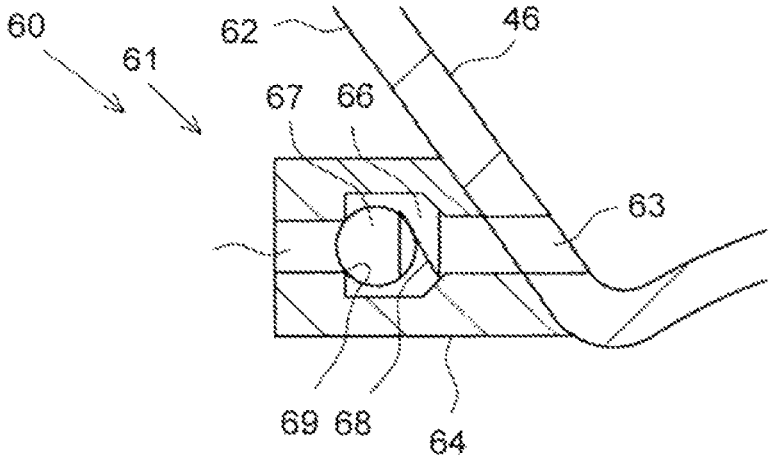
FIG. 3 is a schematic cross-sectional rear view illustrating a drain mechanism.

As shown in FIG. 2 and FIG. 3, the drain mechanism 60 is provided at the lowest position of the heat chamber 24, specifically, at the lower left corner, and is capable of discharging oil accumulated in the heat chamber 24 as much as possible. The drain mechanism 60 includes a drain valve which can be opened and closed, and the drain valve prevents oil from being discharged when the drain valve is closed, and allows oil to be discharged when the drain valve is opened. In the present embodiment, the drain valve is a check valve 61.

At the lowest position of a left wall part 62 which forms a left inner wall surface 46 of the heat chamber 24, a horizontal drain hole 63 is formed through the left wall part 62. The check valve 61 is attached to an outer surface of the left wall part 62 by appropriate means such as welding, bolting, or the like so as to communicate with the drain hole 63.

The check valve 61 includes a main valve body 64 attached to the left wall part 62, a valve hole 65 formed through the main valve body 64, a valve body chamber 66 provided in the middle of the valve hole 65 such that the diameter of the valve hole 65 expands, a valve body 67 disposed in the valve body chamber 66, and a spring 68 serving as a biasing member that biases the valve body 67 toward a valve closing side.

The valve hole 65 coaxially communicates with the drain hole 63, and extends in the left-right direction and the horizontal direction. The valve body 67 is a metal ball such as an iron ball. The spring 68 biases the valve body 67 toward the left side which is the opposite side to the heat chamber 24, thereby closing the check valve 61. Therefore, in the example shown in the drawing, the left side which is the opposite side to the heat chamber 24 is the valve closing side, and the right side which is close to the heat chamber 24 side is the valve opening side. The spring 68 is a coil spring.

Meanwhile, as shown in FIG. 2, the check valve 61 is accessible through a hole provided in the flywheel housing 10, i.e. a housing hole 70. The housing hole 70 is specifically a service hole for performing visual checking of the inside of the flywheel housing 10 and so on after assembly, and is usually blocked with a detachable plug 71 such as a screw-in plug. If the plug 71 is removed, it becomes possible to access the check valve 61 from the outside of the flywheel housing 10. The valve hole 65 faces the housing hole 70 positioned on its left side.

The flow of blow-by gas in the configuration of the present embodiment is as shown by the arrows in FIG. 1 and FIG. 2. Blow-by gas from which oil has been separated by the oil separator 22 flows into the heat chamber 24 through the upstream side gas pipe 25 and the introduction port 30. In the heat chamber 24, as shown in FIG. 2, the blow-by gas discharged from the introduction port 30 enters the lower space 50 linearly and smoothly through the gap 48. The blow-by gas first advances to the left side in the lower space 50, and makes a U-turn to the right side, and rises in the gap 48, and enters an upper space 52 partitioned by the partition wall 44. Then, the blow-by gas advances to the left side in the upper space 52, and is discharged from the discharge port 32 into the downstream side gas pipe 26. Thereafter, the blow-by gas flows through the downstream side gas pipe 26, and is discharged into the outside air (i.e. released into the atmosphere) through the outlet part 33.

As described above, it is possible to make the blow-by gas meander in the heat chamber 24, thereby making the blow-by gas temporally stay.

Relatively high temperature oil in the gear chamber 14 lubricating the gear mechanism 13 is attached to the flywheel housing 10 and the lid 41, so the flywheel housing 10 and the lid 41 are heated by the oil. Therefore, due to this heat, it is possible to heat the blow-by gas in the heat chamber 24 to keep it warm, or at least, it is possible to prevent its temperature from dropping. Therefore, it is possible to prevent generation of condensed water attributable to condensation of moisture contained in the blow-by gas, freezing of condensed water in the gas pipe 23, and blocking of the inside of the gas pipe 23 by freezing. Since the blow-by gas is made meander and stay in the heat chamber 24, a long heating time is secured, and this is advantageous to prevent generation of condensed water and so on.

Especially, as blow-by gas flows to the downstream side in the gas pipe 23 exposed to the outside air, it is likely cooled by the outside air and its temperature decreases. The most remarkable part is the outlet part 33 of the downstream side gas pipe 26 where the temperature of blow-by gas decreases the most. Meanwhile, the outside air including a traveling wind entering the outlet part 33, and in a cold region, for example, the outside air entering the outlet part 33 is also very cold. Under such circumstances, condensed water and freezing are likely to occur in the outlet part 33.

However, according to the configuration of the present embodiment, since blow-by gas can be heated by the heat chamber 24 provided in the middle of the gas pipe 23, the temperature of the blow-by gas that reaches the outlet part 33 is raised, so it is possible to effectively prevent generation and freezing of condensed water in the outlet part 33.

Also, according to the configuration of the present embodiment, since the heat chamber 24 is formed by the hollow space 40 provided integrally with the flywheel housing 10 and the lid 41 closing the hollow space 40, it is possible to easily form the heat chamber as compared to a case where a heat chamber which is a completely closed space is formed in the flywheel housing. Also, since the lid 41 is detachable, it is possible to remove the lid 41 to inspect and maintain the inside of the heat chamber 24 if necessary. Also, the lid 41 can be regarded as a part of the separated flywheel housing 10.

However, the heat chamber which is the completely closed space may be formed in the flywheel housing.

By the way, in the present embodiment, if oil accumulates in the heat chamber 24 over a long-term use, it is possible to discharge the accumulated oil through the drain mechanism 60.

Figure 4:
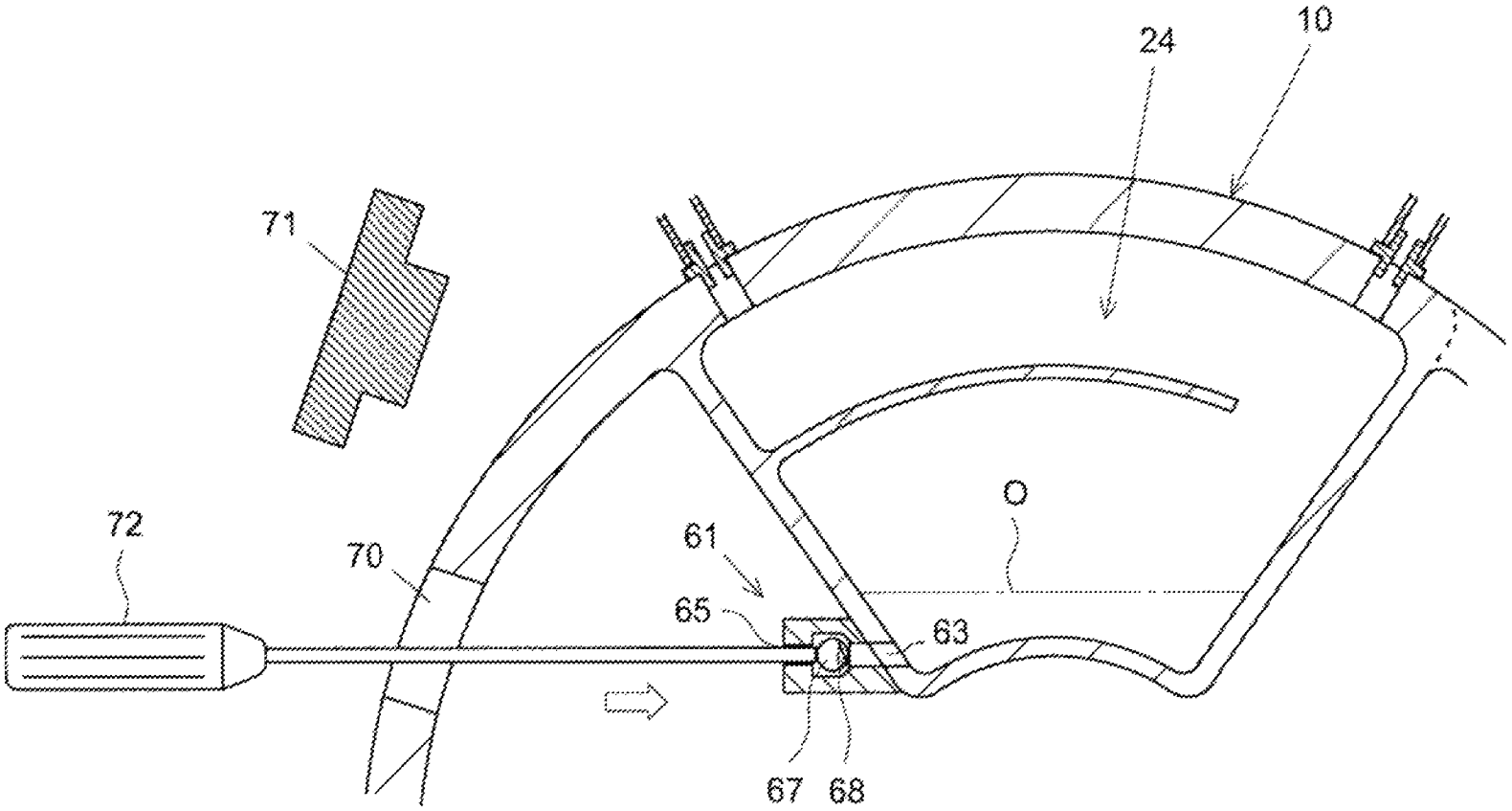
FIG. 4 is a schematic cross-sectional rear view for explaining a working method for discharging oil.

As shown in FIG. 4, when discharging oil O accumulated in the heat chamber 24, a maintenance mechanic removes the plug 71 and inserts a jig or a tool 72 into the flywheel housing 10 through the housing hole 70. Then, the maintenance mechanic inserts a tip of the tool 72 into the valve hole 65 and pushes the tool 72 to the valve opening side (the right side) such that the valve body 67 is pushed out against the biasing force of the spring 68 by the tip of the tool 72, thereby opening the check valve 61.

As a result, the oil O is discharged from the heat chamber 24 through the drain hole 63 and the valve hole 65 in order. The discharged oil O may drop in the flywheel housing 10 However, even though the discharged oil drops, since the inside of the flywheel housing 10 also is oily and the amount of oil is very small, there is no problem.

According to the configuration of the present embodiment, even though oil accumulates in the heat chamber 24, it is possible to discharge the oil regularly at a timing of the maintenance, thereby solving problems attributable to accumulation of oil while preventing accumulation of oil. Also, since it is possible to discharge oil only by inserting the tool 72 through the housing hole 70 and pushing the valve body 67 by the tip of the tool 72, it is possible to easily perform the oil discharge work.

Now, modifications will be described. By the way, parts identical to those of the above-described basic example are denoted by the same reference numbers, and a description thereof will be omitted, and hereinafter, differences from the basic example will be mainly described.

Figure 5:
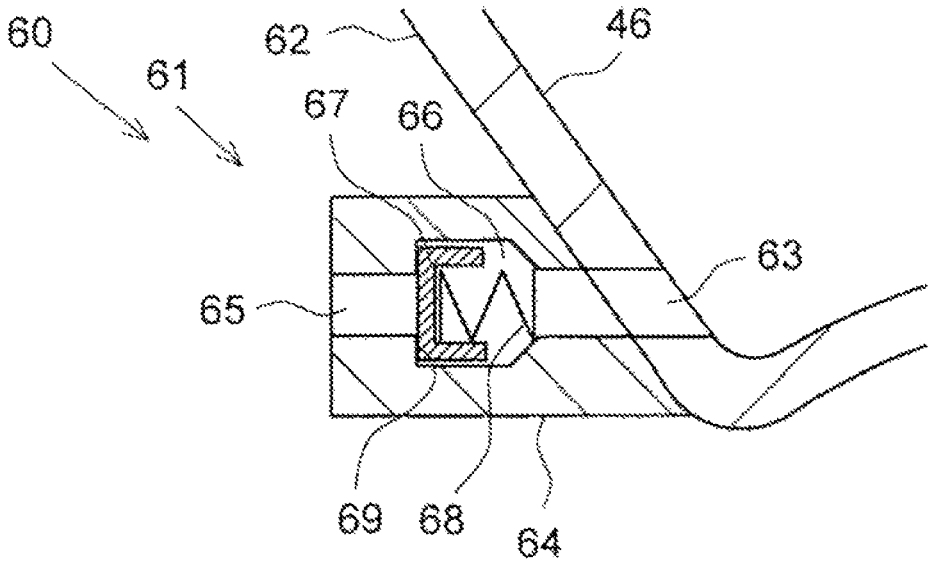
FIG. 5 is a schematic cross-sectional rear view illustrating a drain mechanism according to a first modification.

In a first modification shown in FIG. 5, the valve body 67 of the check valve 61 is a bottomed cylindrical hollow piston. The left end of the valve body 67 is closed, and is pressed against a valve seat 69 by the spring 68. The right end of the valve body 67 is opened, and the spring 68 is inserted into the valve body 67 therefrom.

Figure 6:
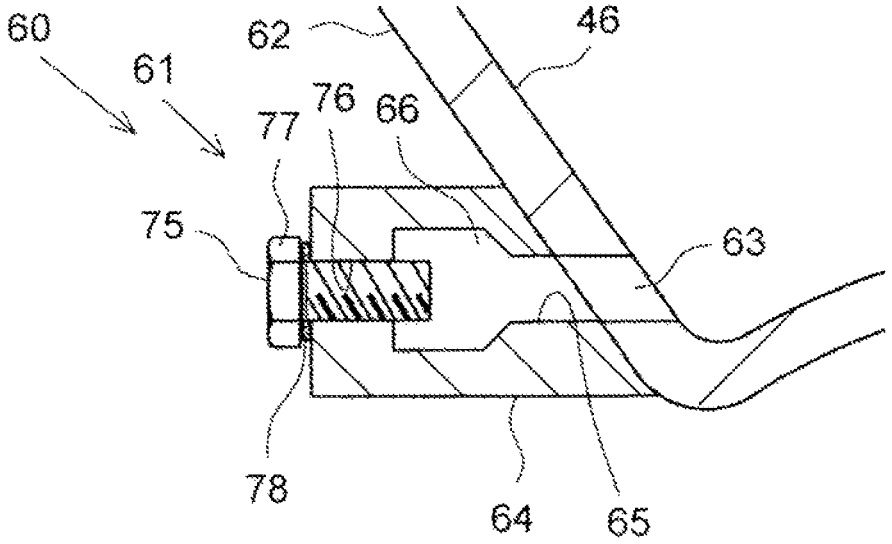
FIG. 6 is a schematic cross-sectional rear view illustrating a drain mechanism according to a second modification.

In a second modification shown in FIG. 6, the drain valve is a drain bolt 75. The drain bolt 75 is tightened to an internal screw 76 provided on an inner surface of an outlet part of the valve hole 65, and blocks the valve hole 65. As a result, the drain valve becomes the closed state. The drain bolt 75 is a general hexagon bolt having a hexagonal head 77, and is tightened to the internal screw 76 with a washer 78 interposed therebetween. When the drain bolt 75 is loosened, oil leaks out from the gap between the drain bolt 75 and the internal screw 76 and is discharged. Therefore, the valve hole 65 becomes substantially the open state, and the drain valve becomes the open state. As described above, the drain bolt 75 is switched between the closed state and the open state by tightening and loosening, so it can be regarded as a drain valve.

When discharging oil from the heat chamber 24, a socket wrench (not shown in the drawing) is inserted into the flywheel housing 10 through the housing hole 70, and a socket part of the socket wrench is fit on the head 77. Then, the socket wrench is turned to loosen the drain bolt 75, whereby the drain valve becomes the open state, and oil is discharged.

Figure 7:
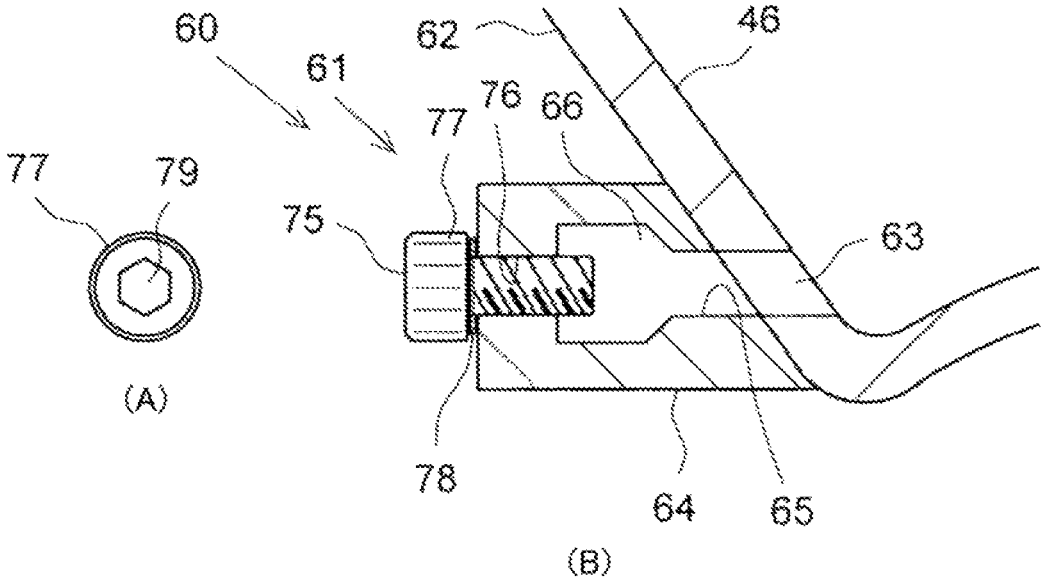
FIG. 7 Parts (A) and (B) of FIG. 7 show a drain mechanism according to a third modification, part (A) of FIG. 7 is a left side view of a drain bolt, and part (B) of FIG. 7 is a schematic cross-sectional rear view.

In a third modification shown in parts (A) and (B) of FIG. 7, the drain bolt 75 is a general hexagon socket head cap screw having a hexagon hole 79. When discharging oil from the heat chamber 24, a hexagon wrench is inserted through the housing hole 70, and the drain bolt 75 is loosened by the hexagon wrench.

Figure 8:
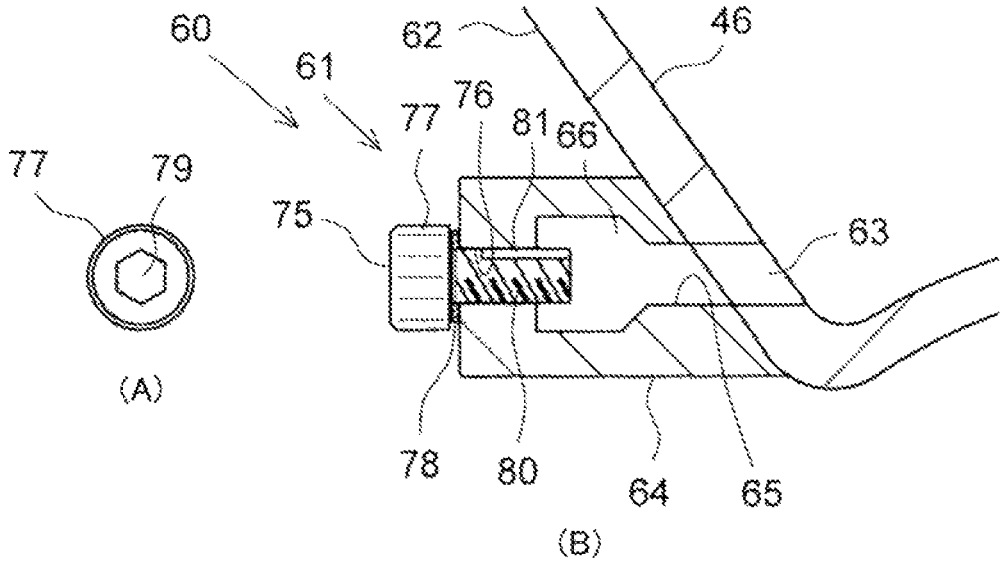
FIG. 8 Parts (A) and (B) of FIG. 8 show a drain mechanism according to a fourth modification, and part (A) of FIG. 8 is a left side view of a drain bolt, and part (B) of FIG. 8 is a schematic cross-sectional rear view.

In a fourth modification shown in parts (A) and (B) of FIG. 8, the drain bolt 75 is also a hexagon socket head cap screw. However, in an external screw part 80 of the drain bolt 75, a groove 81 is provided and extends in the axial direction. According to this configuration, when the drain bolt 75 is loosened, it is possible to allow oil to flow through the groove 81 more aggressively, so it is possible to more quickly discharge oil. Since the groove 81 is longer than the internal screw 76, when the drain bolt 75 is loosened such that the groove 81 extends from a position that is beyond the internal screw 76 on the heat chamber 24 side to a position that is beyond the internal screw 76 on the opposite side to the heat chamber 24, it is possible to quickly discharge oil using the internal screw 76 as a shortcut. The groove 81 can be applied to arbitrary drain bolts including the drain bolt 75 of the second modification (FIG. 6).

Figure 9:
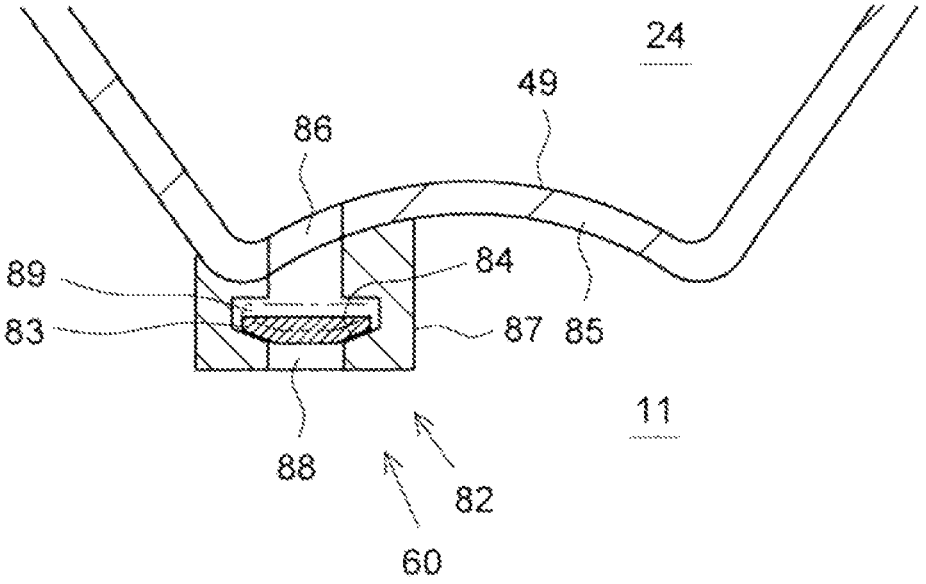
FIG. 9 is a schematic cross-sectional rear view illustrating a drain mechanism according to a fifth modification.

In a fifth modification shown in FIG. 9, the drain mechanism 60 is a check valve 82 However, this check valve 82 is a gravity type, not a spring type, unlike the basic example (FIG. 3).

That is, a valve body 83 of the check valve 82 seats on a valve seat 84 due to its own weight when the engine stops, whereby the check valve 82 is closed. On the other hand, when the engine operates, due to the pressure in the flywheel chamber 11 that is increased by rotation of the flywheel 8, the valve body 83 rises as shown by an imaginary line, whereby the valve body is separated from the valve seat 84 and the check valve 84 is opened. Therefore, it is possible to discharge oil when the engine operates.

In the present modification, at the lowest position of a lower wall part 85 which forms a lower inner wall surface 49 of the heat chamber 24, a vertical drain hole 86 is formed through the lower wall part 85. The check valve 82 is attached to an outer surface of the lower wall part 85 by appropriate means such as welding, bolting, or the like so as to communicate with the drain hole 86.

The check valve 82 includes a main valve body 87 attached to the lower wall part 85, a valve hole 88 formed through the main valve body 87, a valve body chamber 89 provided in the middle of the valve hole 88 such that the diameter of the valve hole 88 expands, and a valve body 83 disposed so as to be movable vertically in the valve body chamber 89. The valve hole 88 coaxially communicates with the drain hole 86, and extends in the vertical direction. The valve body 83 has a disk shape. The valve seat 84 and the peripheral edge of the lower end of the valve body 83 which seats on the valve seat have a tapered shape.

The embodiments of the present disclosure have been described above in detail. However, other embodiments of the present disclosure also are possible.

(1) For example, the oil separator 22 may be omitted. In this case, oil accumulates in the heat chamber 24 for a shorter time, but it is possible to discharge the accumulated oil by the drain mechanism.

(2) The installation position of the drain mechanism can be changed to a position other than the above-mentioned position.

The configurations of the embodiments and the modifications described above can be combined partially or totally unless there is any particular contradiction. Embodiments of the present disclosure are not limited to the above-described embodiments, and all modifications, applications, and equivalents encompassed within the idea of the present disclosure defined by claims are also included in the present disclosure. Therefore, the present disclosure should not be interpreted in a limited manner, and can also be applied to other arbitrary technologies belonging to the range of the idea of the present disclosure.

This application is based on Japanese Patent Application (Japanese Patent Application No. 2018-182123) filed on Sep. 27, 2018, the contents of which are incorporated herein by reference.

INDUSTRIAL APPLICABILITY

According to the present disclosure, it is possible to prevent freezing of condensed water in a blow-by gas pipe.

REFERENCE SIGNS LIST

1 Internal Combustion Engine (Engine)
10 Flywheel Housing
23 Gas Pipe
24 Heat Chamber
33 Outlet Part
60 Drain Mechanism
61 Check Valve
67 Valve Body
68 Spring
70 Housing Hole
75 Drain Bolt

The invention claimed is:

1. A blow-by gas discharge device comprising:

a blow-by gas pipe that extends from a height position of an upper end part of an internal combustion engine to a height position of a lower end part of the internal combustion engine, the blow-by gas pipe being exposed to an outside air and having an outlet part released to an atmosphere;

a heat chamber provided in a middle of the blow-by gas pipe and in a flywheel housing of the internal combustion engine, the heat chamber being configured to heat blow-by gas; and a drain mechanism provided in the heat chamber and configured to discharge oil accumulated in the heat chamber, wherein the drain mechanism includes a drain valve configured to prevent the oil from being discharged when the drain valve is closed and to allow the oil to be discharged when the drain valve is opened, and wherein the drain valve is accessible through a hole provided in the flywheel housing.

2. The blow-by gas discharge device according to claim 1 wherein the drain valve is a check valve, and the check valve includes a valve body and a biasing member configured to bias the valve body toward a valve closing side.

3. The blow-by gas discharge device according to claim 1 wherein the drain valve is a drain bolt.

* * * * *